US009568857B1

(12) United States Patent
Yoshioka

(10) Patent No.: US 9,568,857 B1
(45) Date of Patent: Feb. 14, 2017

(54) DEVELOPING DEVICE AND IMAGE FORMING APPARATUS

(71) Applicant: FUJI XEROX CO., LTD., Tokyo (JP)

(72) Inventor: Sakae Yoshioka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/995,820

(22) Filed: Jan. 14, 2016

(30) Foreign Application Priority Data

Jul. 27, 2015 (JP) ..... 2015-147388

(51) Int. Cl.
*G03G 15/08* (2006.01)

(52) U.S. Cl.
CPC ..... *G03G 15/0889* (2013.01)

(58) Field of Classification Search
CPC ..... G03G 15/0889; G03G 15/0891; G03G 15/0893
USPC ..... 399/106, 254, 256, 258
See application file for complete search history.

(56) References Cited

U.S. PATENT DOCUMENTS 6,195,516 B1 * 2/2001 Ikeda et al. ..... G03G 15/0896 399/254
2008/0145105 A1 6/2008 Iwamura
2011/0123229 A1 5/2011 Takashima et al.

FOREIGN PATENT DOCUMENTS

JP 2008-151997 A 7/2008
JP 2009-115973 A 5/2009
JP 2011-107644 A 6/2011

* cited by examiner

*Primary Examiner* — William J Royer
(74) *Attorney, Agent, or Firm* — Oliff PLC

(57) ABSTRACT

A developing device that develops an electrostatic latent image formed on an image holding member with a developer, the device including a developer transporting chamber, a developer transporting member that transports a developer in the developer transporting chamber in a transport direction with stirring, an initial developer collection chamber that, before using of the developer, collects the developer to cause a developer damming member to prevent the developer from dropping into the developer transporting chamber, and removes the developer damming member and forms an integrated space with the developer transporting chamber when the developer is used, to allow the developer to drop into the developer transporting chamber, and a ceiling member that partially narrows a passage for the developer transported by the developer transporting member, up to a height at which interference with the developer is performed, in the transport direction.

10 Claims, 7 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 20I5-147338 filed Jul. 27, 2015.

BACKGROUND

Technical Field

The invention relates to a developing device and an image forming apparatus.

SUMMARY

According to an aspect of the invention, there is provided a developing device that develops an electrostatic latent image formed on an image holding member with a developer, the device including:

a developer transporting chamber;

a developer transporting member that is disposed in the developer transporting chamber in a direction extended toward a transport direction, and transports a developer in the developer transporting chamber in the transport direction with stirring;

an initial developer collection chamber that is provided at an upper portion of the developer transporting chamber, before using of the developer, collects the developer to cause a developer damming member to prevent the developer from dropping into the developer transporting chamber, and removes the developer damming member and forms an integrated space with the developer transporting chamber when the developer is used, to allow the developer to drop into the developer transporting chamber; and a ceiling member that is disposed in a state of being fixed in the initial developer collection chamber, and partially narrows a passage for the developer transported by the developer transporting member, up to a height at which interference with the developer is performed, in the transport direction.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described.

Figure 1:
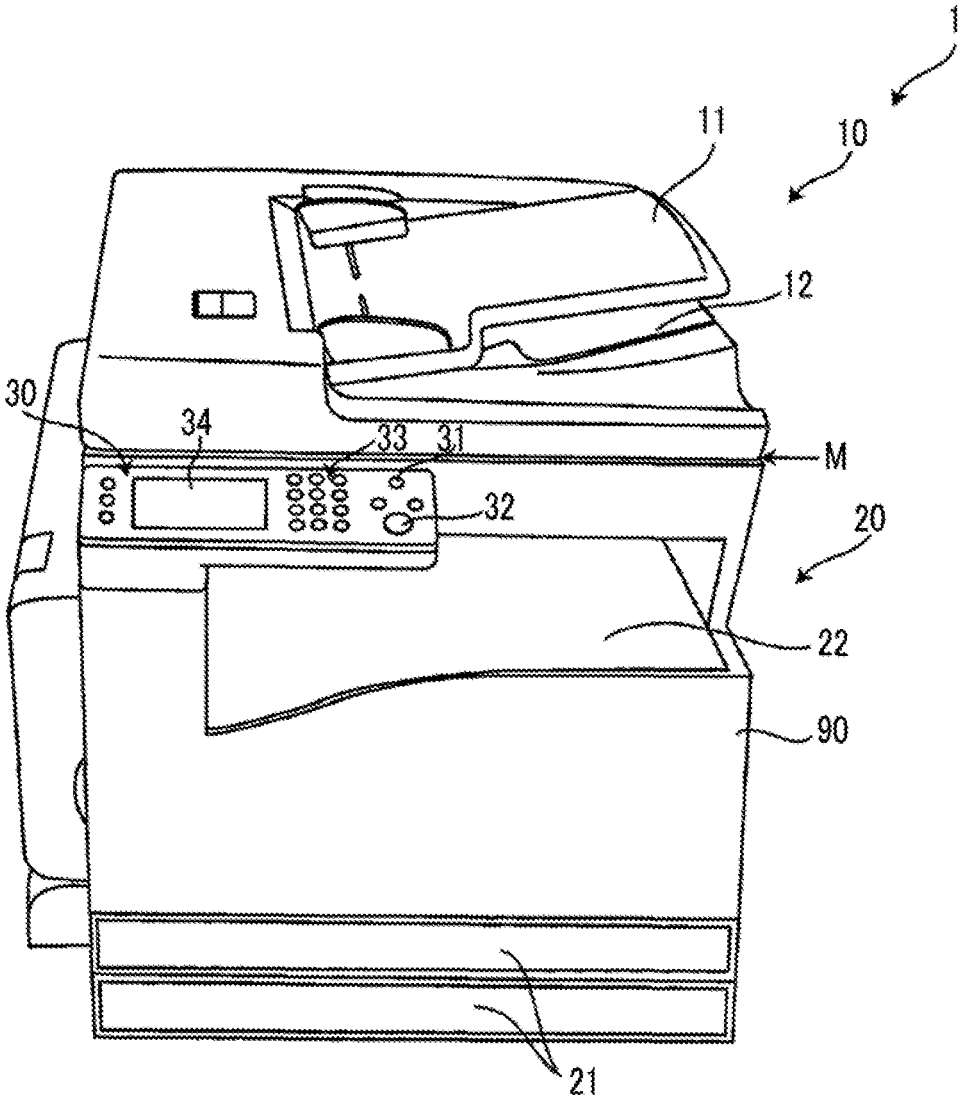
FIG. 1 is an exterior perspective view of an image forming apparatus as an exemplary embodiment of the invention.

FIG. 1 is an exterior perspective view of an image forming apparatus as an exemplary embodiment of the invention.

The image forming apparatus 1 includes an apparatus housing 90 and includes a scanner 10 placed on the apparatus housing 90, and a printer 20 constituted in the apparatus housing 90.

The scanner 10 is a device that reads an image depicted in an original document and generates an image signal. The printer 20 is a device that prints and outputs an image based on the image signal, on paper by using a so-called electrophotographic process.

The scanner 10 includes an original document tray 11 and an original document ejection tray 12. If original documents are placed on the original document tray 11 in a state of being stacked, and a start button 32 is pushed, each piece of the original document is sequentially fed and read, and then is output onto the original document ejection tray 12. In the scanner 10, a hinge (not illustrated) which is extended from side to side is provided and a portion which is higher than a portion indicated by an arrow M may be lift up and be opened. A clear glass plate 13 (see FIG. 2) is spread right under the portion indicated by the arrow M. One piece of an original document is placed downwardly on the clear glass plate 13, and the portion which is higher than the portion indicated by the arrow M is closed. Then, pressing of the start button 32 may cause the original document on the clear glass plate 13 to be read.

The printer 20 is a device that retrieves sequentially each piece of paper from pieces of paper stacked in a paper tray 21 and prints an image based on an image signal onto the retrieved paper. The paper on which an image is printed is output onto an output tray 22.

The image forming apparatus 1 includes a user interface (UI) 30. The UI 30 includes a power button 31, the start button 32, other plural push buttons 33, and a touch-panel type display screen 34. Various instructions such as an instruction of the number of printed pieces of paper, and an instruction of starting an operation are performed by operating the UI 30. A state of this apparatus or various push buttons is displayed on the display screen 34. A push button displayed on the display screen 34 is also to be operated.

Figure 2:
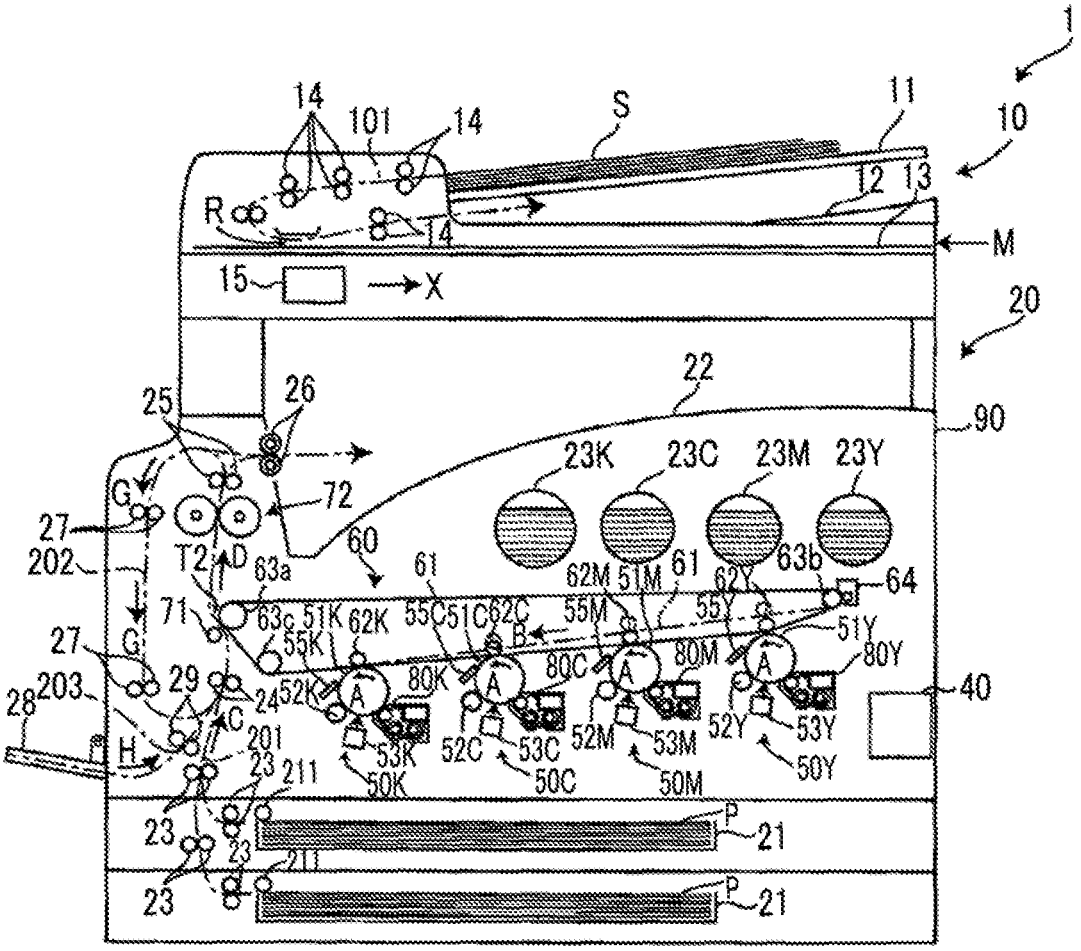
FIG. 2 is a schematic diagram illustrating an internal configuration of the image forming apparatus having an appearance illustrated in FIG. 1.

FIG. 2 is a schematic diagram illustrating an internal configuration of the image forming apparatus 1 having an appearance illustrated in FIG. 1.

If the start button 32 (see FIG. 1) is pushed, each piece of an original document S placed on the original document tray 11 of the scanner 10 is fed and transported onto a transporting path 101 by transport rollers 14. The transported piece of the original document S passes through a reading position R which comes into contact with the clear glass plate 13, in the middle of the transportation, and then is output onto the original document ejection tray 12. When the original document S passes through the reading position R, a reading device 15 which is stationary so as to face the reading position R reads and converts an image recorded in the original document S into an image signal.

The portion which is higher than the portion indicated by the arrow M is opened, and one piece of an original document S is placed downwardly on the clear glass plate 13. Then, the start button 32 is pushed. Then, the reading device 15 reads and converts the original document S on the clear glass plate 13 into an image signal with moving of the reading device 15 in a direction indicated by an arrow X.

The printer 20 includes four image forming units 50Y, 50M, 50C, and 50K which are arranged substantially-transversely in a line. The image forming units 50Y, 50M, 50C, and 50K respectively form toner images by using toners of yellow (Y), magenta (M), cyan (C), and black (K).

Each of the image forming units 50Y, 50M, 50C, and 50K includes a photoreceptor 51. The photoreceptor 51 receives driving power and thus is rotated in a direction indicated by arrow A. The photoreceptor 51 forms an electrostatic latent image on a surface of the photoreceptor 51 and forms a toner image by developing, while being rotated.

A charging device 52Y, 52M, 52C and 52K, an exposure device 53Y, 53M, 53C and 53K, a developing device 80Y, 80M, 80C and 80K, a primary transfer device 62Y, 62M, 62C and 62K, and a photoreceptor cleaner 55Y, 55M, 55C and 55K are provided around the photoreceptor 51Y, 51M, 51C and 51K included in each of the image forming units 50Y, 50M, 50C, and 50K. Regarding common descriptions in the charging device 52Y, 52M, 52C and 52K, the exposure device 53Y, 53M, 53C and 53K, the developing device 80Y, 80M, 80C and 80K, the primary transfer device 62Y, 62M, 62C and 62K, the photoreceptor cleaner 55Y, 55M, 55C and 55K and the photoreceptor 51Y, 51M, 51C and 51K, reference signs of Y, M, C, and K denoted for distinguishing of colors of the toners are omitted and the charging device 52Y, 52M, 52C and 52K, the exposure device 53Y, 53M, 53C and 53K, the developing device 80Y, 80M, 80C and 80K, the primary transfer device 62Y, 62M, 62C and 62K, the photoreceptor cleaner 55Y, 55M, 55C and 55K and the photoreceptor 51Y, 51M, 51C and 51K are designated the charging device 52, the exposure device 53, the developing device 80, the primary transfer device 62, the photoreceptor cleaner 55 and the photoreceptor 51.

The primary transfer device 62 is disposed at a position at which an intermediate transfer belt 61 (which will be described later) is interposed between the primary transfer device 62 and the photoreceptor 51. The primary transfer device 62 is a component included in an intermediate transfer unit 60 (which will be described later), not in the image forming units 50Y, 50M, 50C, and 50K.

The charging device 52 uniformly charges the surface of the photoreceptor 51.

The exposure device 53 irradiates the photoreceptor 51 which is uniformed charged, with exposure light which is modulated based on the image signal. Thus, the exposure device 53 forms an electrostatic latent image on the photoreceptor 51.

The developing device 80 develops the electrostatic latent image formed on the photoreceptor 51 by using the toner of a color corresponding to each of the image forming units 50Y, 50M, 50C, and 50K. Thus, the developing device 80 forms a toner image on the photoreceptor 51.

The primary transfer device 62 transfers the toner image formed on the photoreceptor 51 onto the intermediate transfer belt 61 (which will be described later).

The photoreceptor cleaner 55 has a blade shape. The photoreceptor cleaner 55 is pressed onto the photoreceptor 51, and scraps the remaining toner and the like which adhere to the photoreceptor 51 after transfer, from the photoreceptor 51.

In the image forming apparatus 1 according to this exemplary embodiment, the developing device 80 has a structure of being detachable by extraction from the apparatus housing 90 and being freely mounted by insertion. In the image forming apparatus 1 according to this exemplary embodiment, the photoreceptor 51 has a structure of being attachable and detachable to and from the apparatus housing 90 in a state of being integrated with the charging device 52 and the photoreceptor cleaner 55 around the photoreceptor 51. In this exemplary embodiment, the photoreceptor 51 and the like, and the developing device 80 have an individual structure of being attachable and detachable to and from the apparatus housing 90. However, the photoreceptor 51 and the developing device 80 may have a configuration of being attachable and detachable only in a state of being integrated with each other.

The intermediate transfer unit 60 is disposed over the four image forming units 50Y, 50M, 50C, and 50K. The intermediate transfer unit 60 includes the intermediate transfer belt 61. The intermediate transfer belt 61 is supported by plural rolls 63*a*, 63*b*, and 63*c*. The intermediate transfer belt 61 performs circulation movement on a circulation path in a direction indicated by an arrow B. The circulation path includes a path along four photoreceptors 51 which are respectively included in the four image forming units 50Y, 50M, 50C, and 50K.

The toner image on each of the photoreceptors 51 is transferred so as to be sequentially overlapped with each other on the intermediate transfer belt 61, by an action of the primary transfer device 62. The toner image transferred onto the intermediate transfer belt 61 is transported to a secondary transfer position T2 by the intermediate transfer belt 61.

The secondary transfer position T2 includes a secondary transfer device 71. The secondary transfer device 71 functions as follows. The secondary transfer device 71 comes into contact with a second surface (which is a back surface of a first surface directed toward the intermediate transfer belt 61 side) of a paper transported to the secondary transfer position T2. The secondary transfer device 71 receives application of a transfer voltage and draws the toner image on the intermediate transfer belt 61 to the paper P side so as to cause the toner image to be transferred onto the paper P.

After the toner image is transferred onto the paper P, the remaining toner and the like on the intermediate transfer belt 61 is removed from the intermediate transfer belt 61 by an intermediate transfer belt cleaner 64.

The printer 20 has a monochrome mode and a color mode. In the monochrome mode, only the image forming unit 50K which forms a toner image by using a black (K) toner and is positioned at one end of a sequence (at an end on the leftmost side in FIG. 2) prints a monochrome image on the paper P. In the color mode, a color image is printed on the paper P by using the four image forming units 50Y, 50M, 50C, and 50K. The intermediate transfer belt 61 moves with coming into contact with the four photoreceptors 51 which respectively constitute the four image forming units 50Y, 50M, 50C, and 50K, in the color mode by using a cam mechanism (not illustrated). A circulation movement path is changed in the monochrome mode, such that the intermediate transfer belt 61 comes into contact with only a photoreceptor 51K of the image forming unit 50K positioned at the one end of the sequence (at the end on the leftmost side in FIG. 2), and is separated from photoreceptors 51Y, 51M, and 51C of other image forming units 50Y, 50M, and 50C. In the monochrome mode, operations of other image forming units 50Y, 50M, and 50C except for the image forming unit 50K are shopped and thus power saving or component life extending is provided.

Toner cartridges 23Y, 23M, 23C and 23K that respectively collect toners of colors are provided over the intermediate transfer unit 60. If the toner in the developing device 80 is consumed by developing, the toner is fed from the toner cartridges 23Y, 23M, 23C and 23K that collect the toner of the corresponding color to the developing device 80 through a toner feeding path (not illustrated). The toner cartridges 23Y, 23M, 23C and 23K are formed so as to be attachable and detachable. If the toner cartridges 23Y, 23M, 23C and 23K are empty, the toner cartridges 23Y, 23M, 23C and 23K are extracted and new toner cartridges 23Y, 23M, 23C and 23K are mounted.

Two paper trays 21 are provided at a lower portion of the printer 20. Pieces of paper P which are not printed are collected in each of the paper trays 21, in a state of being stacked. These paper trays 21 are formed to be drawable for replenishment or exchange of paper P.

When an image is formed, either of the two paper trays 21 is designated. Every time an image is formed, one piece of paper P is extracted from the designated paper tray 21 by a pickup roll 211. The extracted piece of paper P is transported to timing adjusting rolls 24 on a transporting path 201 in a direction indicated by an arrow C, by transport rollers 23. The paper P transported to the timing adjusting rolls 24 is sent toward the secondary transfer position T2 by the timing adjusting rolls 24 such that the paper P reaches the secondary transfer position T2 at a timing when the toner image on the intermediate transfer belt 61 reaches the secondary transfer position T2. The action of the secondary transfer device 71 causes the toner image to be transferred at the secondary transfer position T2 onto the paper P sent by the timing adjusting rolls 24 from the intermediate transfer belt 61. The paper P onto which the toner image has been transferred is transported in a direction indicated by an arrow D, and passes through a fixing machine 72. The toner image on the paper P is fixed on the paper P by heating and pressing of the fixing machine 72. Thus, an image formed from the fixed toner image is printed onto the paper P. The paper on which the toner image is fixed by the fixing machine 12 is transported by transport rollers 25 and is sent onto the output tray 22 by output rolls 26.

The printer 20 has a double-sided printing mode in which images are printed on both sides of paper P. In the double-sided printing mode, an image is printed on the first surface of paper P in a manner similar to the above descriptions, and then the paper P of which the image is printed on the first surface is sent to the middle of being transported toward the output tray 22, by the output rolls 26. The output rolls 26 reverses the rotation direction thereof and thus draws back the paper P sent to the middle of being transported toward the output tray 22.

The paper P which has been drawn back by reversing of the output rolls 26 is transported on a transporting path 202 in a direction indicated by an arrow G, by transport rollers 27. Thus, the transported paper P reaches the timing adjusting rolls 24 again. At this time, the paper P has a state where a front surface is reversed when an image is printed on the first surface. After the paper P reaches the timing adjusting rolls 24 again, an image is printed on the second surface of the paper P in a manner similar to the above descriptions. The paper P of which the images have been printed on both of the sides in this manner is sent to the output tray 22 by the output rolls 26.

The printer 20 includes a manual feed tray 28. If paper is placed on the manual feed tray 28 and then the start button 32 is pushed, the paper on the manual feed tray 28 is transported on a transporting path 203 in a direction indicated by an arrow H, by transport rollers 29, and reaches the timing adjusting rolls 24. A printing operation after the paper reaches the timing adjusting rolls 24 is similar to a printing operation performed on the paper P drawn from the paper trays 21.

The image forming apparatus 1 includes a control section 40 for controlling the units. The control section 40 controls the above operations.

Figure 3:
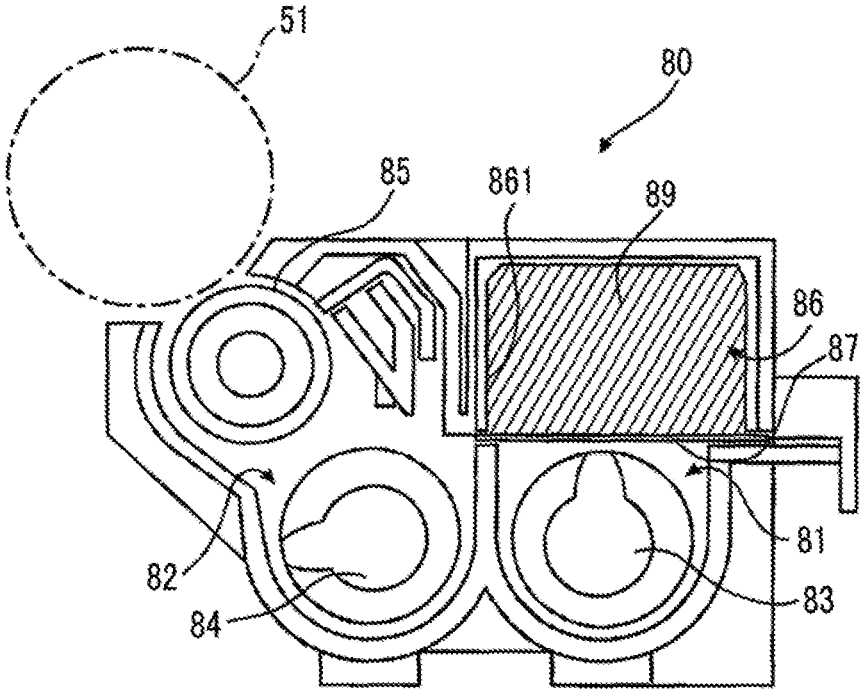
FIG. 3 is a schematic diagram illustrating a cross-sectional structure of one developing device.

FIG. 3 is a schematic diagram illustrating a cross-sectional structure of one developing device 80. FIG. 3 illustrates a developing device 80 of an initial state before a start of a use.

The developing device 80 includes a first developer transporting chamber 81 and a second developer transporting chamber 82 which are extended in a direction perpendicular to the surface of paper so as to be parallel with each other. The first developer transporting chamber 81 and the second developer transporting chamber 82 are linked to each other by passages (first passage 811 and second passage 812 illustrated in FIGS. 4A to 4C and 5A to 5C) which are respectively provided at both ends of the developing device 80 in the direction perpendicular to the surface of paper in FIG. 3. The first developer transporting chamber 81 and the second developer transporting chamber 82 are empty in an initial state before a start of a use illustrated in FIG. 3. A developer has not been collected in the first developer transporting chamber 81 and the second developer transporting chamber 82. A developer formed from a mixture of a toner and a magnetic carrier is collected in the first developer transporting chamber 81 and the second developer transporting chamber 82, as will be described later. The first developer transporting chamber 81 includes a first auger 83. The first auger 83 has a shape extended in the direction perpendicular to the surface of paper, and rotation of the first auger 83 causes the developer in the first developer transporting chamber 81 to be transported in the direction perpendicular to the surface of paper. Similarly, the second developer transporting chamber 82 includes a second auger 84. Similarly to the first auger 83, the second auger 84 has a shape extended in the direction perpendicular to the surface of paper, and rotation of the second auger 84 causes the developer in the second developer transporting chamber 82 to be transported in the direction perpendicular to the surface of paper. A direction in which the developer in the first developer transporting chamber 81 is transported by the first auger 83 is reversed to a direction in which the developer in the second developer transporting chamber 82 is transported by the second auger 84. Accordingly, the developer transported in the first developer transporting chamber 81 by the first auger 83 flows into the second developer transporting chamber 82 at one end portion of the developing device 80 through the first passage 811 (see FIGS. 4A to 4C and 5A to 5C) which links the first developer transporting chamber 81 and the second developer transporting chamber 82 to each other. The developer transported in the second developer transporting chamber 82 by the second auger 84 flows into the first developer transporting chamber 81 at another end portion of the developing device 80 through the second passage 812 (see FIGS. 4A to 4C and 5A to 5C) which links the first developer transporting chamber 81 and the second developer transporting chamber 82 to each other. In this manner, the developer is circularly transported through the first developer transporting chamber 81 and the second developer transporting chamber 82. During circular transportation of the developer, the toner and the magnetic carrier constituting the developer are stirred. The stirring causes the toner and the magnetic carrier to be charged with static electricity, and electrostatic force binds the toner and the magnetic carrier to each other.

The developing device 80 includes a developing roll 85 at a position of being adjacent to the second developer transporting chamber 82. Some areas of the developing roll 85 in the rotation direction thereof are in the second developer transporting chamber 82. Other some areas of the developing roll 85 in the rotation direction thereof are at a position facing the photoreceptor 51. In the developer in the second developer transporting chamber 82, the magnetic carrier constituting the developer is pulled to a magnet disposed in the developing roll 85 and is magnetically pressed on the developing roll 85. The magnetic carrier is transported along with the toner which is electrostatically bound with the magnetic carrier, into an area facing the photoreceptor 51 by rotation of the developing roll 85. An electrostatic latent image formed on the photoreceptor 51 is developed by using the toner in the developer formed from the toner and the magnetic carrier which has been transported into the area. Thus, a toner image is formed on the photoreceptor 51.

As described above with reference to FIG. 2, a toner image formed on the photoreceptor 51 is transferred onto the intermediate transfer belt 61 by the primary transfer device 62, and is transferred onto paper P by the secondary transfer device 71. Then, the secondarily-transferred toner image is fixed on the paper P by the fixing machine 72. In this manner, if the amount of the toner in the developing device 80 is reduced, the insufficient toner is fed from the corresponding toner cartridge 23Y, 23M, 23C and 23K.

In the developing device 80 illustrated in FIG. 3, an initial developer collection chamber 86 is provided right over the first developer transporting chamber 81. A developer 89 is enclosed in the initial developer collection chamber 86 in a state where the developing device 80 has not been used. The initial developer collection chamber 86 and the first developer transporting chamber 81 which is right under the initial developer collection chamber 86 are partitioned off by using an enclosure film 87.

As described above, the developing device 80 is attachable and detachable to and from the apparatus housing 90. Thus, a design in which the developer 89 or the toner constituting the developer 89 is not leaked from the developing device 80 in a state before a use is required. In the developing device 80 according to this exemplary embodiment, the developer 89 is enclosed in the initial developer collection chamber 86, and thus leakage is reliably prevented.

In the developing device 80, the enclosure film 87 is pulled out when the developing device 80 is used. If the enclosure film 87 is pulled out, the initial developer collection chamber 86 and the first developer transporting chamber 81 are integrally formed to be one room. The developer which has been enclosed in the initial developer collection chamber 86 is dropped into the first developer transporting chamber 81 and is collected in the first developer transporting chamber 81. The developing device 80 is mounted to the apparatus housing 90 and an electrostatic latent image on the photoreceptor 51 is developed through the above-described operations by using the toner. A configuration in which the enclosure film 87 is removed after the developing device 80 is mounted to the apparatus housing 90 may be made.

Here, descriptions for this exemplary embodiment are suspended, and a comparative example will be described next. For easy understanding, FIGS. 4A to 4C illustrate components which correspond to the components in this exemplary embodiment and are denoted by the same reference signs as the reference signs in the drawings illustrating this exemplary embodiment.

Figure 4A:
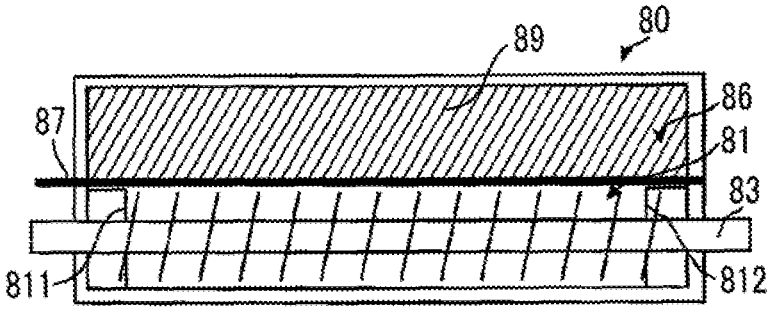
FIGS. 4A to 4C are schematic cross-sectional views illustrating vertical sections of an initial developer collection chamber and a first developer transporting chamber in a direction perpendicular to a surface of paper of FIG. 3, in a developing device as a comparative example.
Figure 4B:
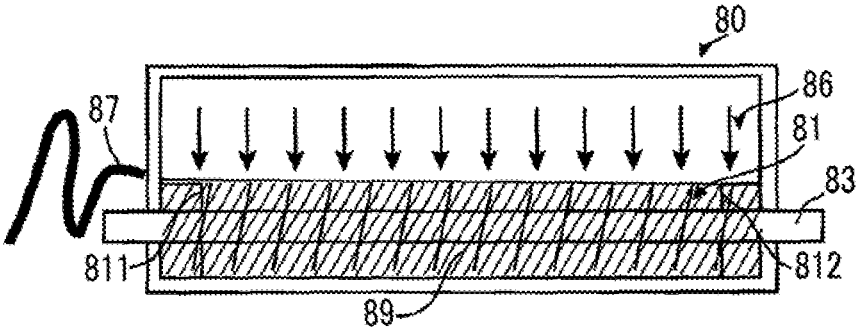
Figure 4C:
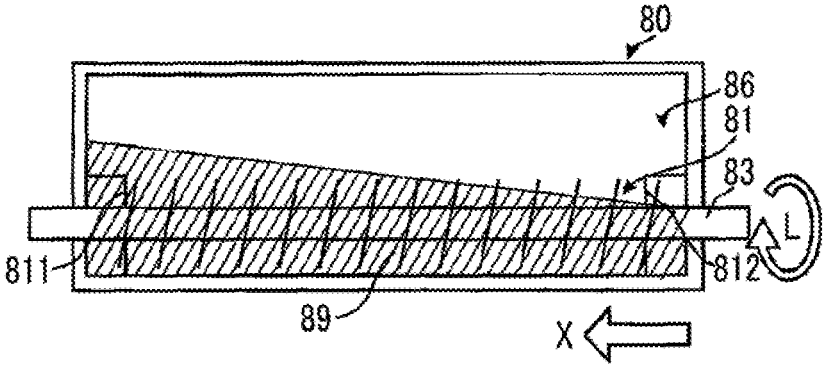

FIGS. 4A to 4C are schematic cross-sectional views illustrating vertical sections of an initial developer collection chamber 86 and a first developer transporting chamber 81 in a direction perpendicular to a surface of paper of FIG. 3, in a developing device as the comparative example.

FIG. 4A illustrates a not-used state where the developer 89 is enclosed in the initial developer collection chamber 86. FIG. 4B illustrates a state right after the enclosure film 87 is removed. FIG. 4C illustrates a state where the developer 89 in the first developer transporting chamber 81 is transported by the first auger 83.

As illustrated in FIGS. 4A to 4C, the first developer transporting chamber 81 in which the first auger 83 is installed and the initial developer collection chamber 86 right over the first developer transporting chamber 81, in which the developer 89 is enclosed in the initial state before a use are also provided in the developing device 80 of this comparative example. The first developer transporting chamber 81 includes the first auger 83. The first auger 83 receives rotation driving force from a driving source (not illustrated) and is rotated in a direction indicated by an arrow L illustrated in FIG. 4C. If the first auger 83 is rotated, the developer in the first developer transporting chamber 83 is transported in the direction indicated by the arrow X illustrated in FIG. 4C, with being stirred. As described above, the first passage 811 and the second passage 812 are formed at both end portions of the first developer transporting chamber 81 in a longitudinal direction. Both of the first passage 811 and the second passage 812 are linked to the second developer transporting chamber 82 (see FIG. 3). The first passage 811 is a passage for sending the developer 89 which has been transported in the first developer transporting chamber 81 in the direction indicated by the arrow X, by the first auger 83 to the second developer transporting chamber 82. The second passage 812 is a passage for inserting the developer 89 which has been transported in the second developer transporting chamber 82 in a direction reverse to the direction indicated by the arrow X, by the second auger 84 illustrated in FIG. 3, into the first developer transporting chamber 81 from the second developer transporting chamber 82.

When the developing device 80 is in the initial state of not being used, as illustrated in FIG. 4A, the developer 89 is enclosed in the initial developer collection chamber 86, and the initial developer collection chamber 86 and the first developer transporting chamber 81 are completely partitioned off with the enclosure film 87.

When the developing device 80 is to be used, ahead of the use, as illustrated in FIG. 4B, the enclosure film 87 is removed. If the enclosure film 87 is removed, a ceiling portion of the first developer transporting chamber 81 is opened, and thus the first developer transporting chamber 81 and the initial developer collection chamber 86 forms one room. The developer enclosed in the initial developer collection chamber 86 is dropped and is collected in the first developer transporting chamber 81. Then, the developing device 80 is accommodated in the apparatus housing 90 of the image forming apparatus 1 illustrated in FIG. 2 and an operation thereof is started. If the operation is started, the first auger 83 (and the second auger 84 or the developing roll 85) is rotated, and the developer in the first developer transporting chamber 81 is transported in the direction indicated by the arrow X.

When the operation of the first developer transporting chamber 81 is started as illustrated in FIG. 4C, the first developer transporting chamber 81 is integrated with the initial developer collection chamber 86 right over the first developer transporting chamber 81, so as to form one room. The formed room has a high ceiling. However, the initial developer collection chamber 86 has a vertical wall 861 and the vertical wall 861 causes the height of the first passage 811 to be limited to the height of the original first developer transporting chamber 81 excluding the initial developer collection chamber 86. Thus, even when the developer 89 in the first developer transporting chamber 81 is transported in the direction indicated by the arrow X by rotation of the first auger 83 and reaches the first passage 811, the entirety of the reached developer 89 may or may not immediately pass through the first passage 811. That is, particularly, for example, when the toner is fed from the toner cartridge 23Y, 23M, 23C and 23K (see FIG. 2) and the developer in the developing device 80 is in a bulky state, as illustrated in FIG. 4C, a state where the developer 89 rises up to a portion of the developing device 80 higher than the first passage 811 occurs. If this state continuously remains for a long time, a portion of the developer 89, which rises up to the portion of the higher than the first passage 811 is not stirred and stays as it is. Thus, aggregation of the toner proceeds. A certain occasion may cause the developer in the process of the aggregation to pass through the first passage 811 and to be inserted into the second developer transporting chamber 82, and the developer in the process of the aggregation may be moved to a position facing the photoreceptor 51 by the developing roll 85 and be used for developing an electrostatic latent image. If the developer in the process of the aggregation is used in developing, image defect may occur due to the aggregation.

This exemplary embodiment includes a section which is described with reference to FIGS. 4A to 4C and is configured to suppress occurrence of the aggregation of the toner in the comparative example.

Figure 5A:
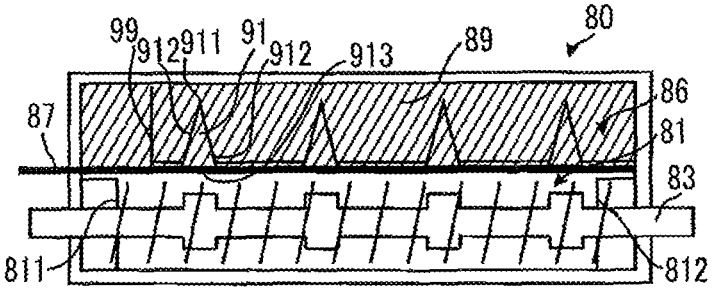
FIGS. 5A to 5C are schematic cross-sectional views illustrating vertical sections of portions of an initial developer collection chamber and a first developer transporting chamber in a developing device according to this exemplary embodiment.
Figure 5B:
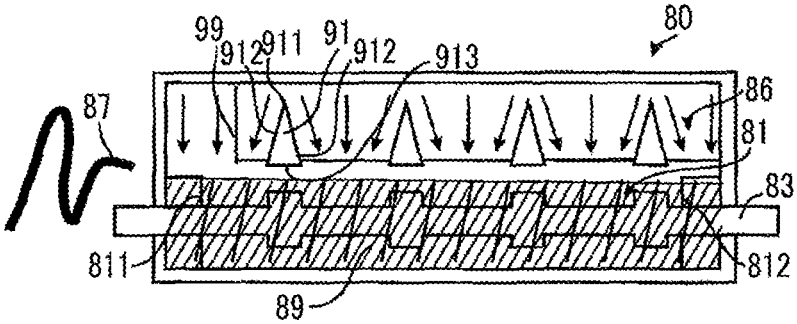
Figure 5C:
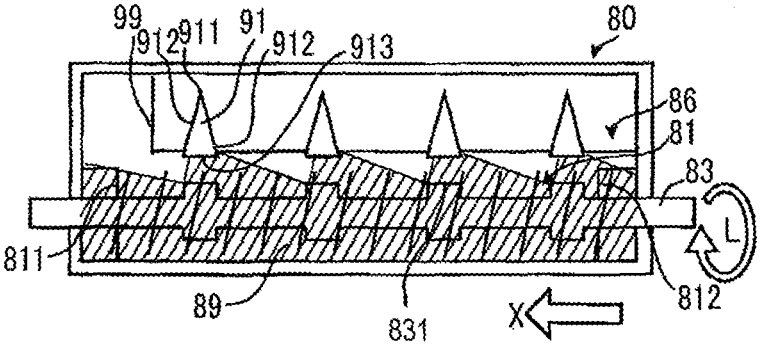

FIGS. 5A to 5C are schematic cross-sectional views illustrating vertical sections of portions of the initial developer collection chamber 86 and the first developer transporting chamber 81 in the developing device 80 according to this exemplary embodiment.

In FIGS. 5A to 5C, components the same as the components illustrated in FIGS. 4A to 4C are denoted by reference signs the same as the reference signs in FIGS. 4A to 4C. A difference between the components in FIGS. 4A to 4C and 5A to 5C will be described.

Figure 6:
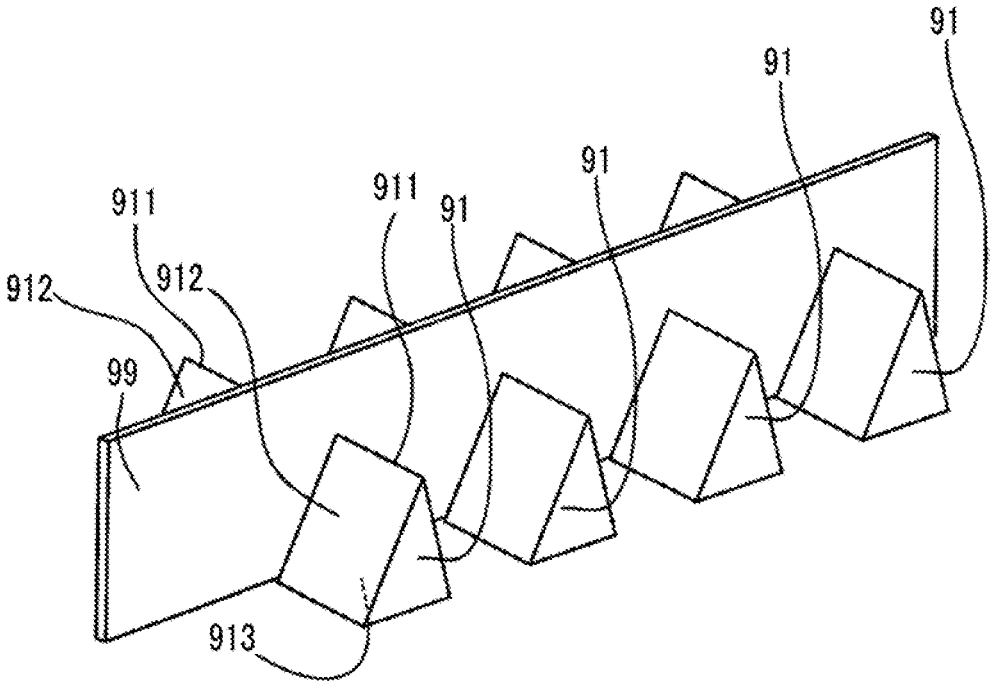
FIG. 6 is a schematic diagram illustrating a ceiling member included in the developing device according to this exemplary embodiment.

FIG. 6 is a schematic diagram of a ceiling member 91 included in the developing device 80 according to this exemplary embodiment.

The developing device 80 in this exemplary embodiment is different from the developing device 80 as the comparative example illustrated in FIGS. 4A to 4C in that a ceiling member 91 illustrated in FIG. 6 is provided. Plural (four in the example described herein) ceiling members 91 are arranged so as to be sequentially disposed at an interval in the transport direction (direction indicated by the arrow X illustrated in FIG. 5C) of the developer 89. The plural ceiling members 91 are supported by one support plate 99, and are installed in the initial developer collection chamber 86.

An upper end or a side edge of the support plate 99 is fixed to the ceiling or the vertical wall 861 of the initial developer collection chamber 86, and the support plate 99 has a state of being hung down toward the first developer transporting chamber 81 from the ceiling side.

Each of the plural ceiling members 91 supported by the support plate 99 has a peak portion 911 protruding upwardly, and an inclined surface 912 which has a wedge shape and is spread downwardly. Each of the plural ceiling members 91 further has a downward bottom surface 913 at a lower part thereof. The bottom surface 913 is positioned at the undermost end of the initial developer collection chamber 86 and is directed toward the first developer transporting chamber 81 under the bottom surface 913 from the ceiling side.

Since the ceiling member 91 has a wedge shape spread downwardly, as illustrated in FIG. 5B, when the enclosure film 87 is removed, the developer 89 in the initial developer collection chamber 86 is smoothly slipped down on the inclined surface 912 of the ceiling member 91. Accordingly, the presence of the ceiling member 91 causes occurrence of a situation in which a portion of the developer 89 remains in the initial developer collection chamber 86 and stirring is not performed, and thus the toner is aggregated to be avoided.

The developer 89 in the first developer transporting chamber 81 is transported in the direction indicated by the arrow X illustrated in FIG. 5C, by the first auger 83 during the operation. However, the developer 89 on the ceiling member 91 side at this time has a necessity of passing through a narrow gap which is formed between the bottom surface 913 of the ceiling member 91 and the first auger 83. Thus, the developer 89 on the ceiling member 91 side is pushed into the narrow gap between the ceiling member 91 and the first auger 83 and is transported in a state of being compressed to a certain extent. In a case of this exemplary embodiment, the first auger 83 has a great-diameter portion 831 at a position facing the ceiling member 91. Even when the first auger 83 is rotated, the great-diameter portion 831 has a shape which continuously protrudes toward the ceiling member 91. Thus, a gap at a portion interposed between the ceiling member 91 and the first auger 83 becomes narrower, and the developer 89 which passes through the gap is compressed more.

The developer 89 which has passed through the gap interposed between the ceiling member 91 and the first auger 83 is released from the compression. The compression and release from the compression causes aggregation of the toner to be prevented or causes the aggregated toner to be released. Thus, a state of no aggregation occurs. In this exemplary embodiment, since the ceiling members 91 are arranged and the developer 89 is blocked a little by each of the ceiling members 91, it is possible to avoid occurrence of a bulky state intensively at the part of the first passage 811 and to avoid occurrence of image defect due to the aggregation of the toner.

In this exemplary embodiment, the initial developer collection chamber 86 and the first developer transporting chamber 81 respectively correspond to examples of an initial developer collection chamber and a developer transporting chamber. The first auger 83 corresponds to an example of a developer transporting member. The enclosure film 87 corresponds to an example of a developer damming member. The great-diameter portion 831 of the first auger 83 corresponds to an example of a protrusion portion of the developer transporting member.

Figure 7:
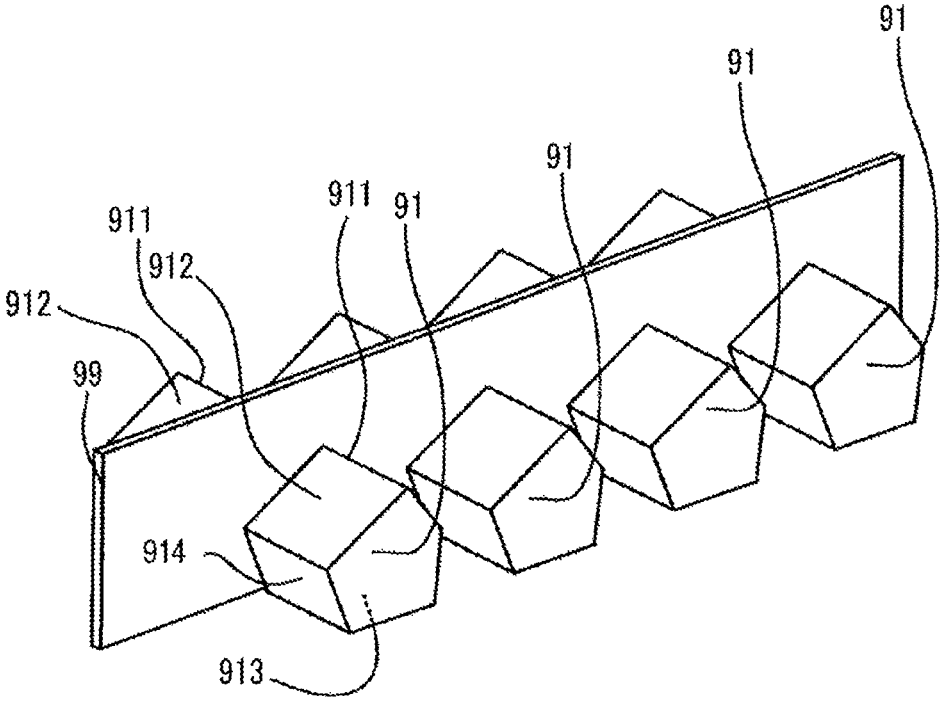
FIG. 7 is a schematic diagram illustrating a modification example of the ceiling member.

FIG. 7 is a schematic diagram illustrating a modification example of the ceiling member 91.

In FIG. 7, components the same as the components illustrated in FIG. 6 are denoted by reference signs the same as the reference signs in FIG. 6. A difference between the components in FIGS. 6 and 7 will be described.

The ceiling member 91 illustrated in FIG. 7 has a portion at which the inclined surface 912 is formed by being spread downwardly from the peak portion 911 at an upper part so as to be a wedge shape. Subsequently to the portion spread so as to be the wedge shape, the ceiling member 91 has a portion at which a second inclined surface 914 is formed by being narrowed downwardly. The bottom surface 913 is spread between lower end edges of second inclined surfaces 914.

The inclined surface 912 at the portion (which is spread downwardly so to be a wedge shape) of the ceiling member 91 illustrated in FIG. 7 functions to assist smooth dropping when the developer in the initial developer collection chamber 86 is dropped into the first developer transporting chamber 81, similarly to the inclined surface 912 of the ceiling member 91 illustrated in FIG. 6.

Subsequently to the inclined surface 912, the second inclined surface 914 at the portion narrowed downwardly acts to cause the developer 89 which is transported by the first auger 83 and struck against the ceiling member 91 to be easily inserted into the gap between the bottom surface 913 of the ceiling member 91 and the first auger 83 during an operation. In a case of the ceiling member 91 illustrated in FIG. 7, the presence of the second inclined surface 914 causes a probability that the developer 89 struck against the ceiling member 91 holds a state of being struck against the ceiling member 91 to be lowered. Accordingly, concern that image defect occurs due to the aggregation of the toner is reduced.

The ceiling member 91 in FIG. 7 has second inclined surfaces 914 which are formed on both sides of an upstream side and a downstream side in the transport direction of the developer 89. This is used for completing attachment of the ceiling member 91 without a consideration of a direction of the ceiling member 91 when the ceiling member 91 is attached to the support plate 99. As the above action, the second inclined surface 914 may be formed only on the upstream side of the transport direction.

As the ceiling member 91, FIGS. 6 and 7 illustrate two examples. However, the ceiling member 91 is not limited to the shapes in FIGS. 6 and 7 and may have any shape as long as the ceiling member 91 forms a narrow gap through which the developer 89 passes between the ceiling member 91 and the first auger 86.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device that develops an electrostatic latent image formed on an image holding member with a developer, the device comprising:

a developer transporting chamber;

a developer transporting member that is disposed in the developer transporting chamber in a direction extended toward a transport direction, and transports a developer in the developer transporting chamber in the transport direction with stirring;

an initial developer collection chamber that is provided at an upper portion of the developer transporting chamber, before using of the developer, collects the developer to cause a developer damming member to prevent the developer from dropping into the developer transporting chamber, and removes the developer damming member and forms an integrated space with the developer transporting chamber when the developer is used, to allow the developer to drop into the developer transporting chamber; and a ceiling member that is disposed in a state of being fixed in the initial developer collection chamber, and partially narrows a passage for the developer transported by the developer transporting member, up to a height at which interference with the developer is performed, in the transport direction.

2. The developing device according to claim 1, wherein the ceiling member has a shape protruding upwardly and a downward bottom surface at a lower portion thereof.

3. The developing device according to claim 2, wherein a plurality of ceiling members that are disposed at an interval in the transport direction are provided.

4. The developing device according to claim 3, wherein the developer transporting member includes a protrusion portion that protrudes toward the ceiling member, at a position facing the ceiling member.

5. The developing device according to claim 2, wherein the developer transporting member includes a protrusion portion that protrudes toward the ceiling member, at a position facing the ceiling member.

6. An image forming apparatus comprising:

a latent image forming unit that forms an electrostatic latent image on an image holding member;

a developing unit that includes the developing device according to claim 2 and develops the electrostatic latent image formed on the image holding member with a developer; and a transfer and fixing unit that transfers a visible image formed on the image holding member by the developing unit onto paper, and fixes the transferred image.

7. The developing device according to claim 1, wherein a plurality of ceiling members that are disposed at an interval in the transport direction are provided.

8. The developing device according to claim 7, wherein the developer transporting member includes a protrusion portion that protrudes toward the ceiling member, at a position facing the ceiling member.

9. The developing device according to claim 1, wherein the developer transporting member includes a protrusion portion that protrudes toward the ceiling member, at a position facing the ceiling member.

10. An image forming apparatus comprising:

a latent image forming unit that forms an electrostatic latent image on an image holding member;

a developing unit that includes the developing device according to claim 1 and develops the electrostatic latent image formed on the image holding member with a developer; and a transfer and fixing unit that transfers a visible image formed on the image holding member by the developing unit onto paper, and fixes the transferred image.

* * * * *